US005637010A

United States Patent [19]

Jost et al.

[11] Patent Number: 5,637,010

[45] Date of Patent: Jun. 10, 1997

[54] CONNECTOR PAIR

[75] Inventors: Werner Jost, Leinfelden-Echterdingen; Günter Wittwer, Hagen, both of Germany

[73] Assignee: Contact GmbH Elektrische Bauelemente, Germany

[21] Appl. No.: 411,624

[22] PCT Filed: Jul. 27, 1994

[86] PCT No.: PCT/EP94/02482

§ 371 Date: May 10, 1995

§ 102(e) Date: May 10, 1995

[87] PCT Pub. No.: WO95/04390

PCT Pub. Date: Feb. 9, 1995

[30] Foreign Application Priority Data

Aug. 2, 1993 [DE] Germany ..... 43 25 895.6

[51] Int. Cl.[6] ..... H01R 13/627

[52] U.S. Cl. ..... 439/352; 439/372

[58] Field of Search ..... 439/345, 350, 439/352, 353, 372

[56] References Cited

U.S. PATENT DOCUMENTS 3,848,950 11/1974 McCormick et al. .
4,017,139 4/1977 Nelson .
5,011,424 4/1991 Simmons ..... 439/352
5,082,455 1/1992 Wei ..... 439/352

FOREIGN PATENT DOCUMENTS

0141958A1 9/1984 European Pat. Off. .
3928710A1 8/1989 Germany .

*Primary Examiner*—Khiem Nguyen
*Attorney, Agent, or Firm*—Wood, Herron & Evans, L.L.P.

[57] ABSTRACT

A connector pair with a plug (1) and a receptacle (1'), each of which comprises at least one contact insert (7, 7') in which at least one contact (9, 9') is arranged, whereby free ends (13, 13') of the housings (3, 3') can be joined in such a manner that the free end (13) of the other housing (3) projects into the open inner space (14') on the face of the one housing (3') and the contacts (9, 9') of the plug (1) and the receptacle (1') come into engagement with each other, is adapted such that in the area of the free end (13) at least one recess (17) is provided in an outer wall of the one housing (3), in the area of the free end (13') of the other housing (3') at least one engaging element (20) corresponding to the recess (18) is provided, which in a first position projects into the inner space (14') of the other housing (3') and in a second position clears the inner space (14') of the other housing (3'), and that a sleeve (30) surrounding the free end (13') is arranged, which in a rest position urges the engaging element (20) into the inner space (14') of the other housing (3') and in an operative position allows the engaging element (20) to escape from the inner space (14') of the other housing (3').

15 Claims, 3 Drawing Sheets

CONNECTOR PAIR

PATENT SPECIFICATION

The present invention relates to a connector pair with the features of the preamble clause of Claim 1.

Such connector pairs have been described in the prior art in the most different embodiments and are commonly employed. Such designs are particularly popular in high power current connectors. However, a great plurality of such designs is also available for low power current connectors.

A number of connector pairs is known, which can be interlocked by bayonet-type, screwed-type or snap-type mechanisms or the like. With these known connector pairs, however, the plug and the receptacle cannot simply be assembled without operating a locking element which in the assembled condition keeps the two components in a securely connected position and is to be operated only for disconnecting the two components.

From DE 39 28 710 A1 an electrical plug-in connection with two connecting elements is known, where one connecting element has at least one locking element supported in a forced guidance of a housing and being radially movable by means of an axial slide, which in the locked position engages a shoulder of the other connecting element and which can be controlled by manual displacement of the axial slide subjected to a spring arrangement into an unlocking position to release the shoulder. The spring arrangement is formed by a partially loosely fitting punched sheet part, the loosely fitting sections of which are operated by the axial slide.

The locking elements are arranged in a tangential direction with respect to the hollow space of the housing and travel radially outward upon clearing of the housing hollow space.

From U.S. Pat. No. 4,017,139 an electrical plug-in connection is known where spring tongues arranged in a circular cylindrical manner have radially inwardly facing projections with semi-circular sections in the areas of their free ends, which can engage a corresponding annular groove of a mating connector. Moreover, projections are arranged at the outer surface of the spring elements, which can engage a recess in a ring surrounding the spring elements upon displacement of the ring in order to disconnect the two plug-in connectors. In the engaged condition of the plug-in connectors the outer projections of the spring elements bear against the inner wall of the ring so that the the spring elements cannot yield radially in an outward direction.

For the purpose of a convenient operation it is desirable to achieve such an operability.

In view of this, the present invention is based on the problem to provide a connector pair of the initially mentioned type which allows for this way of operation.

To solve this problem, the engaging element of the initially mentioned connector pair is designed in a manner as defined in the characterizing clause of Claim 1.

This design permits a simple plug-in operation of the plug and the receptacle without requiring the sleeve to be operated. Although there is a possibility to bring the sleeve in its operated position where it might facilitate the plug-in operation, it is not mandatory to displace the sleeve.

Additional advantages, properties and characteristics of the invention are the subject of the dependent claims and will be explained with reference to the accompanying drawings, in which:

Figure 1:
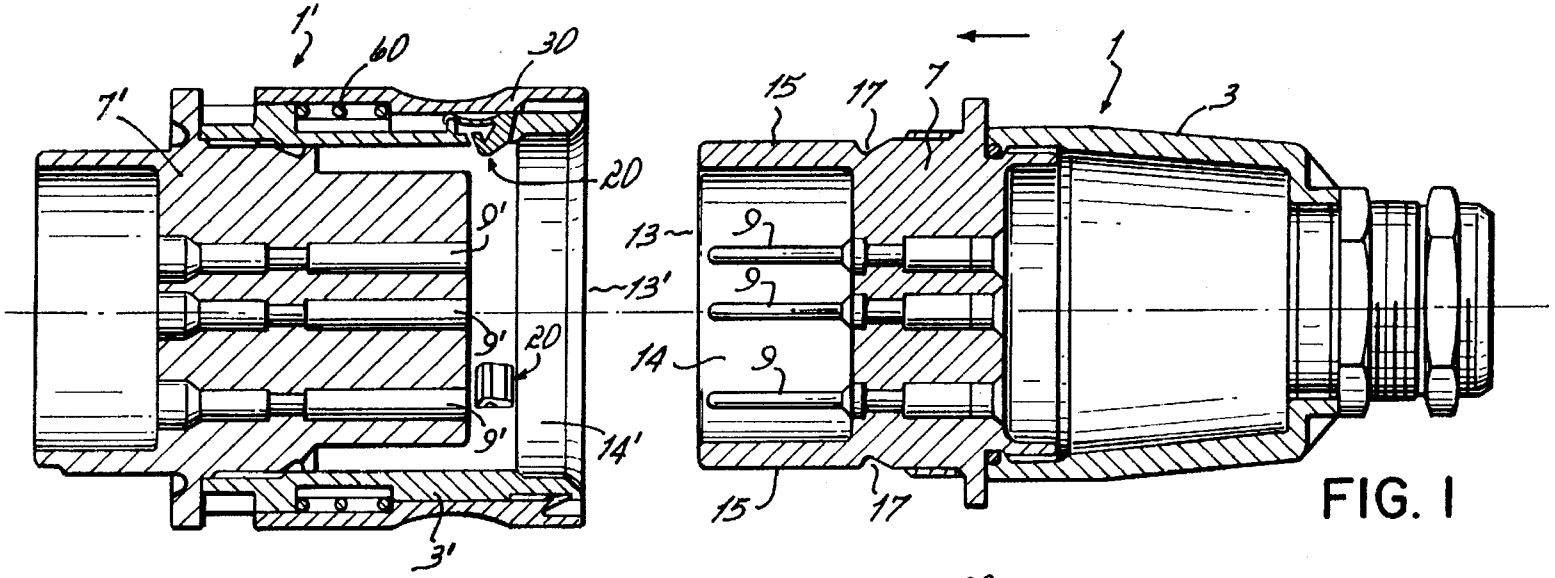
FIG. 1 shows a schematic longitudinal section of a connector pair in the disconnected condition.
Figure 3:
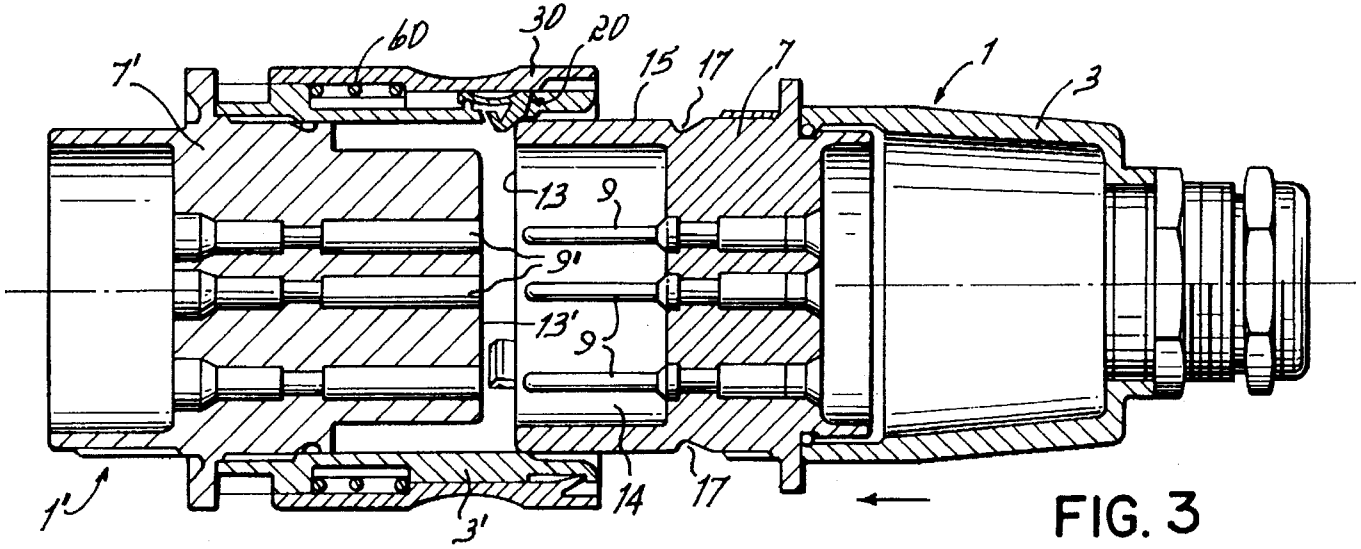
FIG. 3 shows the connector pair of FIG. 1 in a first intermediate position during the plug-in operation.

The drawings illustrate a connector pair, the plug and receptacle of which are designed as round plug-in connectors. The principle of the invention can, however, also be realized for plug-in connectors with an angular sectional shape. Moreover, there is the possibility to employ the principle of the invention not only for free connectors but also for built-in units.

Each of a plug 1 and a receptacle 1' of a connector pair has a tubular housing 3, 3'. Each housing 3, 3' can be constructed as an integral component but can also consist of several sections. If the housing 3, 3' is made of several sections, this would be advantageous in that different series could be realized with only a few parts requiring replacement. In this manner, e.g. built-in connectors, coupling connectors, angle connectors etc. can be manufactured in a simple manner.

In each housing 3, 3' a contact insert 7, 7' with several contact pins 9 or contact jacks 9', respectively, is arranged. Because each contact insert 7, 7' is arranged so as to be set back in the interior of the respective housing 3, 3' relative to each free end 13, 13 of the plug 1 or the receptacle 1', respectively, an inner pace 14, 14' remains in each case. Otherwise, each inner space 14, 14' is defined by the essentially hollow cylinder inner wall of the respective housing 3, 3' and the respective contact insert 7, 7'. Each contact insert 7, 7' can include in its circumference at least one coding groove or coding key, respectively (not shown), which defines the angular position of the plug to be inserted into the receptacle 1'.

A circumferential outer surface 15 of the area of the free end 13 of the housing 3 or of the contact insert 7 of the plug 1, respectively, is provided with at least one, usually, however, with several recesses 17. The corresponding area of the free end 13' of the housing 3' of the receptacle 1' is provided with engaging elements 20, the number of which is equivalent to the number of the recesses 17 of the plug 1, which have a three-legged open angular shape. Each engaging element 20 is pivotably mounted on the outer side of the housing 3' with a free end 22 with an enlargement 24 of a first leg 26 via a corresponding rim 28.

Figure 2:
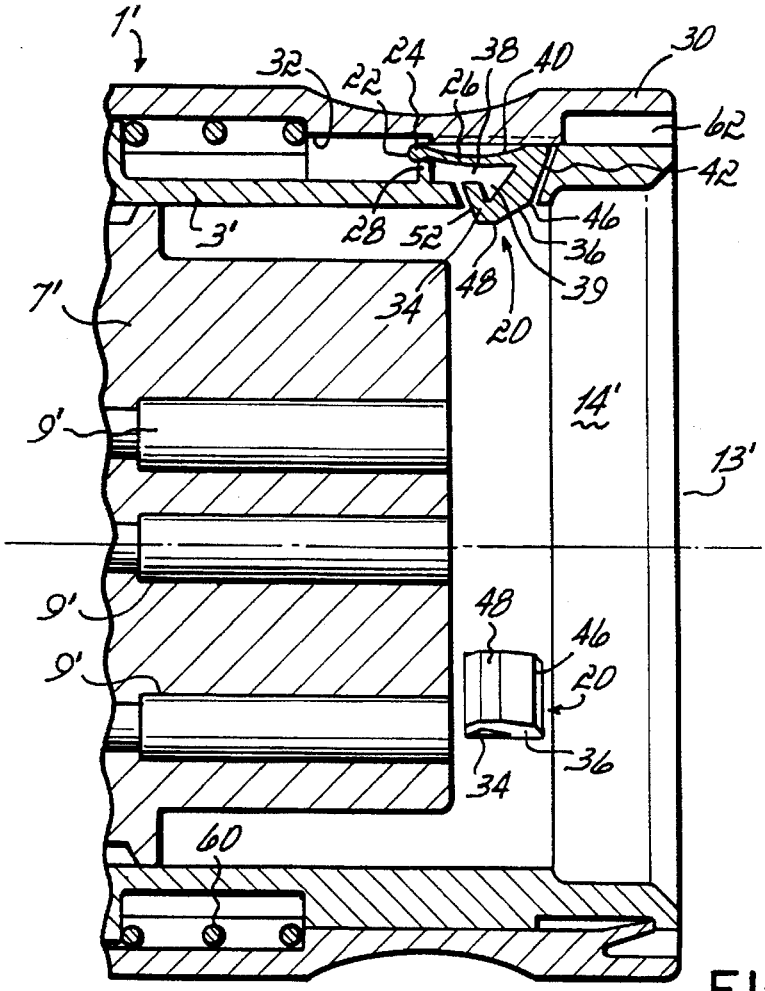
FIG. 2 shows an enlarged detail of FIG. 1 at Z with an engaging element.

A sleeve 30 surrounding the free end 13' of the housing 3' attaches the engaging element 20 to the rim 28 in a pivotable but captive manner because an inner wall 32 of the sleeve 30 is arranged at such a small distance to the rim 28 that the enlargement 24 at the free end 22 of the first leg 26 cannot pass over the rim 28. A second and a third leg 34, 36 are formed at the first leg 26 of the engaging element 20 at the end opposite the enlargement 24. The third leg 36 is integrally formed with the first leg 26, and the second leg 34 forms the bent extension of the third leg 36. In the rest position, the free end of the second leg 34 is separated by an air gap 38 from the first leg (see FIG. 1 or FIG. 2).

In a first position, in which the engaging element 20 or its second and third leg 34, 36, respectively, extend into the free inner space 14' of the receptacle 1', the first leg 26 has a slightly convex bulging toward the second and third leg 34, 36.

The second and third leg 34, 36 of the engaging element 20 are loosely accomodated in an opening 39, with parts of the second and third leg 34, 36 extending into the free inner space 14' so that the plug 1 or the recess 17, respectively, engages the engaging element 20 upon insertion into the receptacle 1' because the second and third leg 34, 36 are provided with correspondingly inclined surfaces as the recess 17.

The angle between the first leg 26 and the third leg 36 is reduced during the transition from the first to the second position because the engaging element 20 is compressed in a radial direction.

An outer surface 42 of the second leg 36 is angled twice, with a first bend 46 extending in the area of an inner edge of the opening 39, and with a second bend 48 leading into the area of the engaging element 20 with the greatest projection into the free inner space 14' of the receptacle 1' or engagement depth into the recess 17, respectively.

Figure 4:
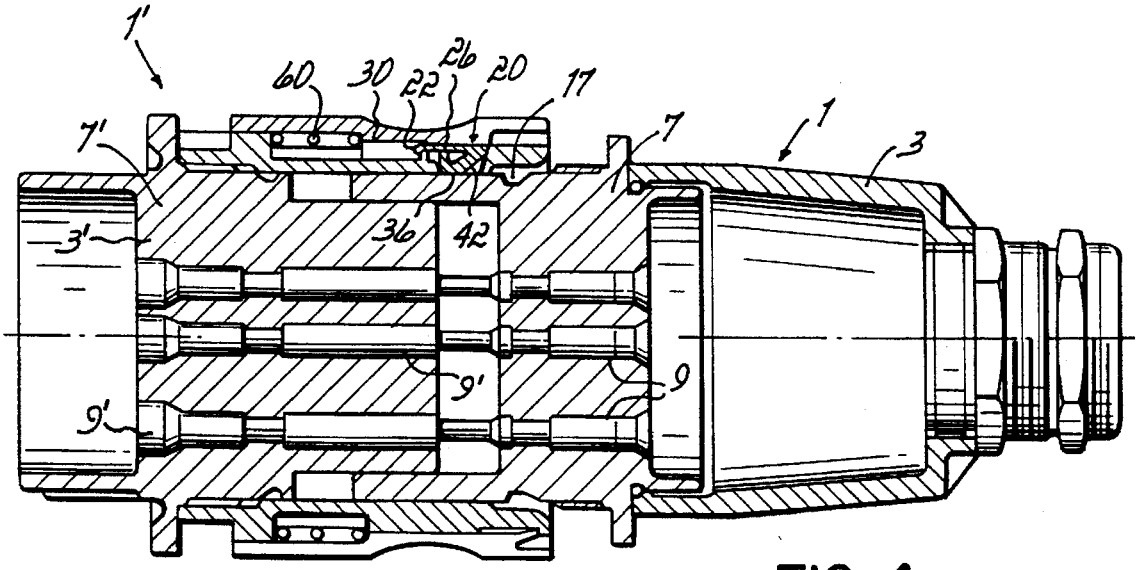
FIG. 4 shows the connector pair of FIG. 1 in a second intermediate position during the plug-in operation.
Figure 5:
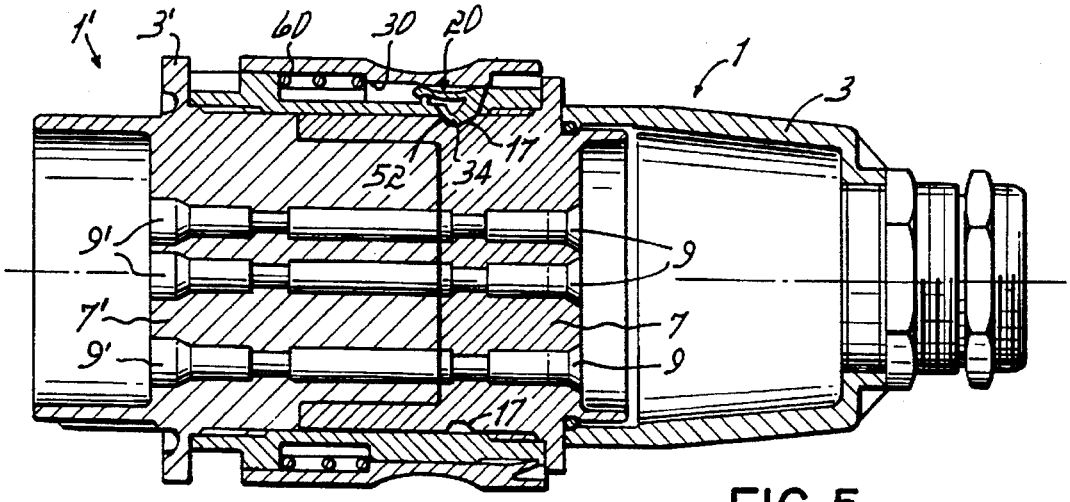
FIG. 5 shows the connector pair of FIG. 1 in the plugged-in condition.

The area between the edge 46 and the edge 48 is inclined so that the free end 13 or the leading edge of the plug 1 can press the engaging element 20 into the opening 39 upon assembling the plug 1 and the receptacle 1', i.e. the first and third leg 34, 36 are pressed into the opening 39 so that the gap 38 between the free end of the second leg 34 and the first leg 26 disappears almost completely and the convex bulging of the first leg 26 is bent to become straight (see FIG. 4). Thereby the inner wall 32 of the sleeve 30 restricts the deformation of the engaging element 20 in a radial direction relative to the center axis of the receptacle 1'.

With the continued insertion of the plug 1 into the receptacle 1' the recess 17 eventually lies immediately below the opening 39 with the engaging element 20, whereupon the second and third leg 34, 36 escape from the opening 39 and positively engage the recess 17. The included angle between an outer surface 52 of the second leg 34 and the outer surface 42 of the third leg 36 is so selected that pulling the plug 1 out of the receptacle 1' is not possible because the outer surface 52 of the second leg 34 and the corresponding surface in the recess 17 are inclined to such an extent that the engaging element 20 cannot be pushed out of the opening 39 in a radial direction.

In the rest position of the illustrated embodiment the outer surface of the third leg 36 and the outer surface 40 of the first leg 26 include an angle of approx. 25° to 85°, and the outer surface 52 of the second leg 34 and the outer surface 42 of the third leg 36 include an angle of approx. 30° to 80°.

Figure 6:
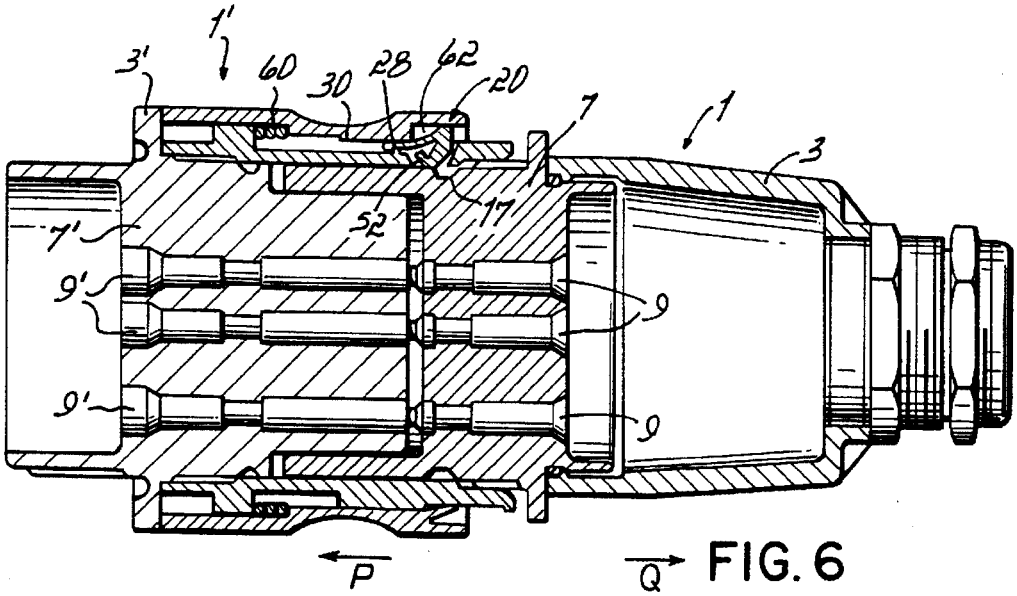
FIG. 6 shows the connector pair of FIG. 1 in a first intermediate position during disconnecting.

Only after the sleeve 30 has been pulled in the axial direction of the receptacle 1' off the free end 13' in the direction of arrow P in FIG. 6 against the force of a coil spring 60 captured between the sleeve 30 and the housing 3', a recessed free space 62 in the inner wall of the sleeve 30 is brought into position. The engaging element 20 can thus—at least partially—escape into this free space 62. A tensile force acting on the plug 1 in the direction of arrow Q (FIG. 6) causes the outer surface 52 of the second leg 34 to slide along its opposite surface of the recess 17 and the engaging element 20 to pivot around the support formed by the connector 28 into the free space 62.

Figure 7:
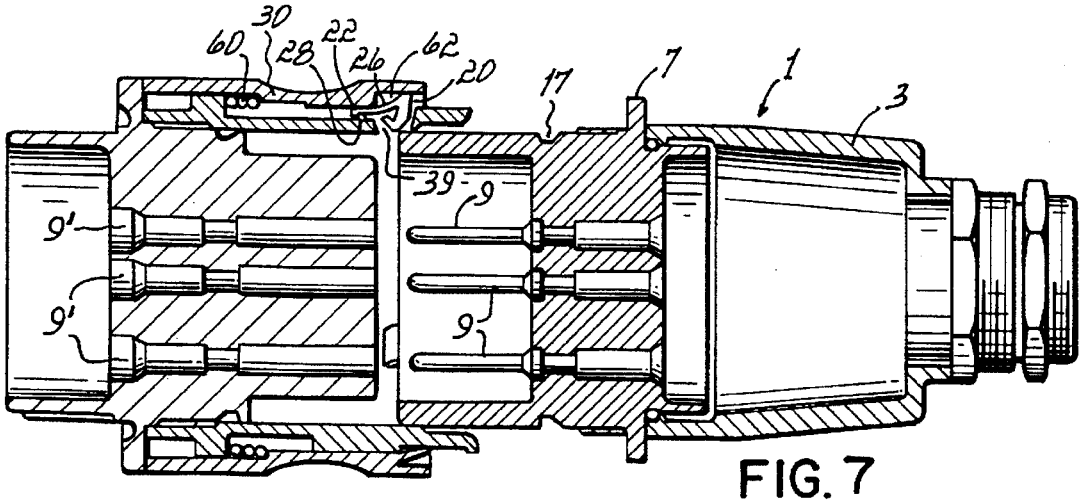
FIG. 7 shows the connector pair of FIG. 1 in a second intermediate position during disconnecting.

As shown in FIG. 7, the plug 1 can then be completely pulled out of the receptacle 1', with the engaging element 20 being virtually completely accommodated in the free space 62 during the disconnecting operation.

Preferably at least three of these engaging elements 20 are spaced around the circumference of the receptacle 1' in order to permit reliable locking and unlocking. Each engaging element is made from polyethylene or a similar plastic and wear resistant material in order to achieve a sufficiently of plugging and disconnecting operations.

It is understood that the engaging element cannot only be arranged on the receptacle side but can also be provided on the plug side.

Moreover, the locking assembly, comprising the sleeve 30 with the engaging elements 20 housed therein, can also be manufactured as a separate component (cf. FIG. 2) which can be attached to the different built-in, coupling and angle connectors etc. This allows a great number of combination possibilities, and particularly simplifies the realization of a cable-to-cable connection with plug coupling part.

The design of the engaging elements 20 is exactly the same as in the previously described embodiments of the engaging elements in the plug-in connector. Their arrangement in the sleeve 30 is also identical with the previously described plug-in connector.

We claim:

1. A connector pair comprising:

a plug (1) and a receptacle (1'), each of which comprises a housing (3, 3') each having at least one contact insert (7, 7') in which at least one contact (9, 9') is arranged, whereby free ends (13, 13') of the housings (3, 3') can be joined in such a manner that the free end (13) of the other housing (3) projects into an open inner space (14') at the face of the one housing (3') and the contacts (9, 9') of the plug (1) and the receptacle (1') come into engagement with each other, a recess (17) being provided in the area of the free end (13) of an outer wall (15) of the one housing (3), at least one engaging element (20) in the area of the free end (13') of the other housing (3'), which corresponds with the recess (17) and which in a first position projects into an inner space (14') of the other housing (3') and in a second position clears the inner space (14') of the other housing (3'), and a sleeve (30) surrounding the free end (13') of the other housing, the sleeve in a rest position contacting and thereby urging the engaging element (20) into the inner space (14') of the other housing (3') and in an operative position allowing the engaging element (20) to escape from the inner space (14') of the other housing (3'), the engaging element (20) in its longitudinal section having a three-legged open angular shape, with a first leg (26) of the angular shape having a free end (22) and extending beyond a second leg (34) of the angular shape.

2. A connector pair according to claim 1, wherein the engaging element (20) is formed to be resilient.

3. A connector pair according to claim 2, wherein the engaging element (20) is connected with the other housing (3') in such a manner that the free end (22) of the first leg (26) is movably accommodated at the housing so that the second leg (34) and a third leg (36) of the engaging element (20) can project through an opening (39) into the inner space (14') of the other housing (3').

4. A connector pair according to claim 1, wherein each of the second leg (34) and the third leg (36) of the engaging element (20) is so inclined that they can essentially be positively accommodated in the recess (17).

5. A connector pair according to claim 1, wherein the outer surface of the third leg (36) and an outer surface (40) of the first leg (26) include an angle of approximately 25° to 85°, and an outer surface (52) of the second leg (34) and an outer surface (42) of the third leg (36) include an angle of approximately 30° to 80°.

6. A connector pair according to claim 1, wherein the first leg (26) in the first position is convexly bulged toward the second (34) and the third leg (36).

7. A connector pair according to claim 1, wherein the angle between the first leg (26) and the third leg (36) decreases during the transition from the first position to the second position.

8. A connector pair according to claim 6 wherein the convex bulging of the first leg (26) and a gap (38) between the first leg (26) and the second leg (34) are so dimensioned that in the second position the first leg (26) bears against the sleeve (30) and the free end of the second leg (34) bears against the first leg (26).

9. A connector pair according to claim 1, wherein the sleeve (30) surrounding the free end (13') of the other housing (3') is biased in its rest position by means of a spring arrangement (60).

10. A connector pair according to claim 1, wherein the sleeve (30) surrounding the free end (13') of the other housing (3') has a free space (62) into which the engaging element (20) in the operative position of the sleeve (30) can escape.

11. A locking assembly with a sleeve (30) which accommodates at least one engaging element (20) which in its longitudinal section comprises a three-legged angular shape, the three legs having inner surfaces, and the three inner surfaces defining an open triangle in longitudinal cross section, with a first leg (26) of the angular shape having a free end (20) and extending beyond a second leg (34) of the angular shape.

12. A connector pair, comprising:

a pair of housings with one of the housings containing a first contact and the other of the housings containing a second contact engageable with the first contact, each of the housings having a free end, the free end of the one housing being engageable into an inner space at the free end of the other housing whereby the first and second contacts come into engagement with each other;

a recess in an outer wall of the one housing;

an engaging element having a first leg with a free end connected to the other housing adjacent the free end of the other housing, and second and third legs angled with respect to the first leg and shaped to correspond with the recess, the engaging element being pivotable about the free end of the first leg and movable from a first position in which the second and third legs project into the inner space of the other housing to a second position in which the second and third legs clear the inner space;

a sleeve surrounding the other housing and axially slidable from a rest position in which an inner surface of the sleeve contacts the first leg of the engaging element and thereby urges the second and third legs into the recess to an operative position in which the sleeve permits the engaging element to pivot about the free end of the first leg and disengage the recess; and a coil spring biasing the sleeve toward the rest position.

13. The connector pair of claim 12, wherein:

the engaging element is radially compressible from the first position to the second position, and the free end of the first leg of the engaging element is captively retained between the inner surface of the sleeve and an outer surface of the other housing in both the rest and operative positions of the sleeve.

14. The connector pair of claim 12, wherein:

the coil spring is axially displaced from and does not contact the engaging elements, the coil spring being disposed between the sleeve and the other housing.

15. The connector pair of claim 12, wherein:

the one housing and first contact comprise a plug, and the other housing and second contact comprise a receptacle.

* * * * *